US011453468B1

(12) United States Patent
Samelian

(10) Patent No.: US 11,453,468 B1
(45) Date of Patent: Sep. 27, 2022

(54) RESCUE DEVICE

(71) Applicant: John Samelian, Mendota Heights, MN (US)

(72) Inventor: John Samelian, Mendota Heights, MN (US)

( * ) Notice: Subject to any disclaimer, the term of this patent is extended or adjusted under 35 U.S.C. 154(b) by 24 days.

(21) Appl. No.: 16/974,241

(22) Filed: Nov. 23, 2020

Related U.S. Application Data

(60) Provisional application No. 62/974,618, filed on Dec. 16, 2019.

(51) Int. Cl.
*B63C 9/08* (2006.01)

(52) U.S. Cl.
CPC ..... *B63C 9/082* (2013.01)

(58) Field of Classification Search
CPC ..... B63C 9/08; B63C 9/082; B63C 9/26
USPC ..... 441/81, 80, 84
See application file for complete search history.

(56) References Cited

U.S. PATENT DOCUMENTS 4,577,262 A * 3/1986 Buteaux ..... B63C 9/22 362/208
5,562,512 A * 10/1996 Samelian ..... B63C 9/26 441/81
8,216,014 B2 * 7/2012 Samelian ..... B63C 9/082 441/81
8,708,762 B2 * 4/2014 Samelian ..... B63C 9/082 441/81
8,951,081 B2 * 2/2015 Grandinetti ..... B63C 9/082 441/81
9,656,732 B1 * 5/2017 Samelian ..... B63C 9/26

* cited by examiner

*Primary Examiner* — Daniel V Venne
(74) *Attorney, Agent, or Firm* — Johnson & Phung LLC

(57) ABSTRACT

A throwable rotateable rescue device having an outer annular chamber for winding storage of a retrieval cord and a connector therein and a loop therein engaged with a connector and cord, which is maintained in the annular chamber during throwing of the rescue ring to a person in distress, the loop extendable out of the annular chamber when the cord and connector are to be engaged or disengaged from the rescue device.

20 Claims, 7 Drawing Sheets

FIG. 3
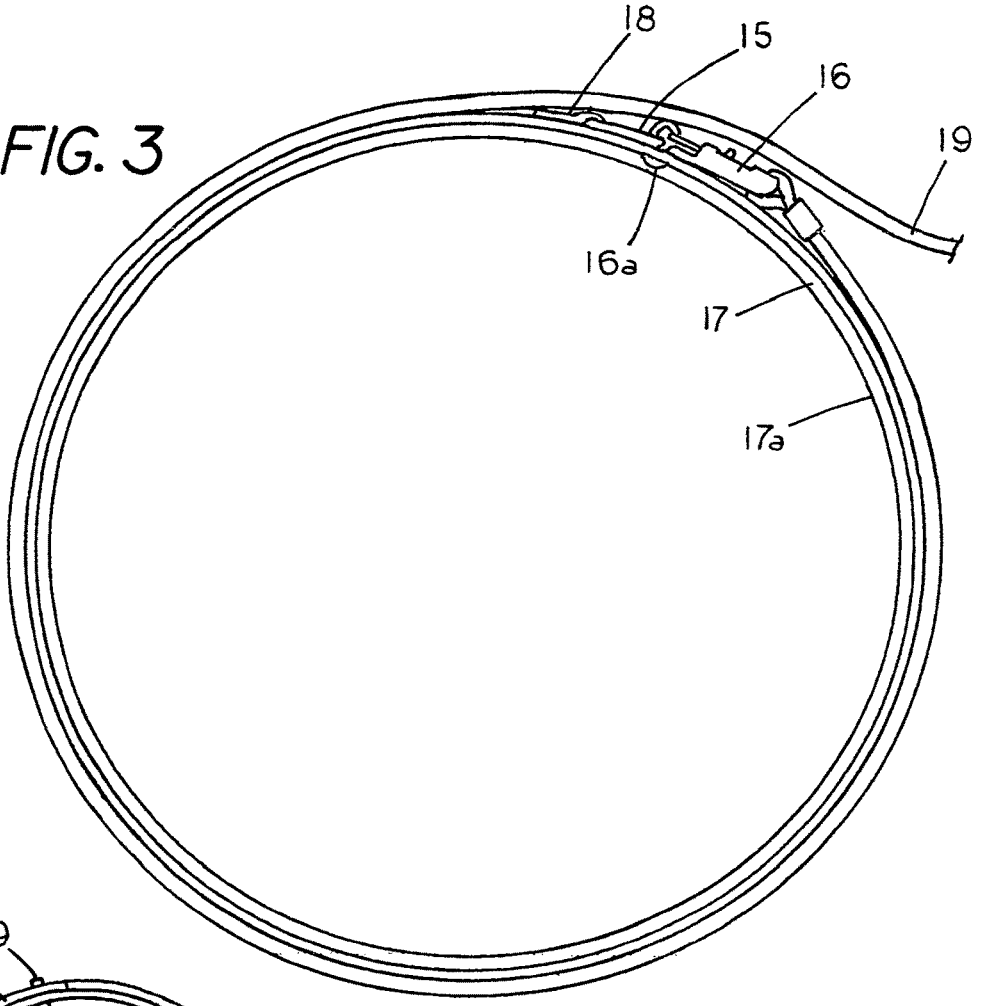
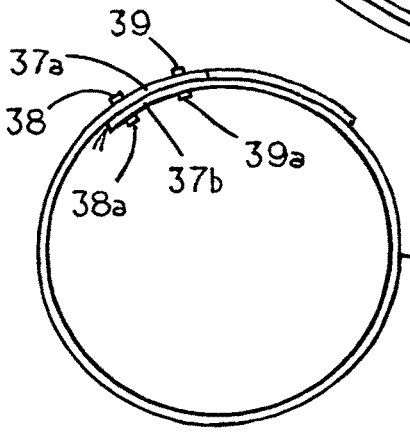
FIG. 3B
FIG. 3A
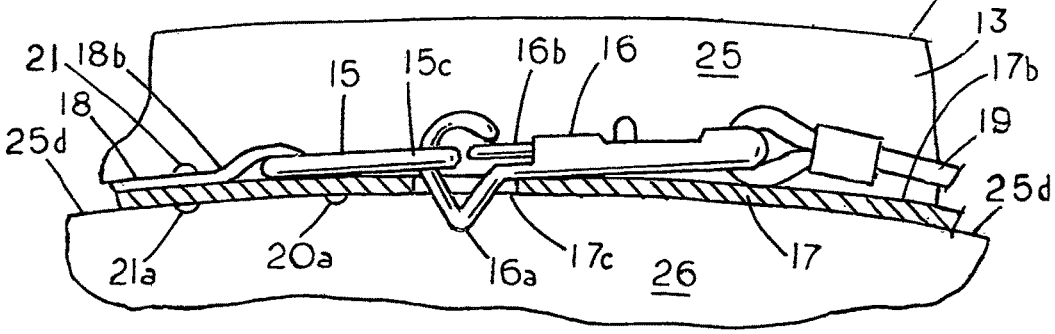

RESCUE DEVICE

CROSS REFERENCE TO RELATED APPLICATIONS

This application claims priority of provisional application Ser. No. 62/974,618 filed Dec. 16, 2019.

STATEMENT REGARDING FEDERALLY SPONSORED RESEARCH OR DEVELOPMENT

None

REFERENCE TO A MICROFICHE APPENDIX

None

BACKGROUND OF THE INVENTION

This invention relates generally to rescue devices and, more specifically, to improvements to throwable rescue rings that increases the versatility and capacity of the throwable rescue rings. Examples of lightweight throwable rescue rings, which have an aerodynamic shape, can be found in my U.S. Pat. Nos. 5,562,512; 8,216,014, 8,708,762 and 9,656,732. My throwable rescue rings have an excellent throwing range and are ideally suited for water rescue since the throwable rescue rings are buoyant and can be hand thrown by an inexperienced person. Typically, a cord, which has one end secured to the throwable rescue ring, unwinds from an annular cord chamber located in a compartment in the throwable rescue ring, as the throwable rescue ring is thrown to a person in distress. The other end of the cord, which is retained by the thrower or may be affixed to a structure, allows the thrower to retrieve the throwable rescue ring by pulling the cord toward the thrower. When the throwable rescue ring is thrown to a person in distress the person grasps the throwable rescue ring and is pulled to safety by the cord, which is attached to the throwable rescue ring.

On some occasions one may want to retrieve objects other than a person, for example, one may want to bring a boat into dock or to rescue a boat in distress. To retrieve a larger or heavier load using the throwable rescue ring to engage and retrieve the larger or heavier load may cause the rescue ring to fracture or break since the throwable rescue ring may not have sufficient structural and tensional integrity to withstand the pulling forces since throwable rescue rings are generally made of lightweight materials so that they can be thrown long distances. In order to retrieve larger loads one can detach the cord from the throwable rescue ring and then attach the cord directly to the larger or heavier load. One can then use the cord, without the throwable rescue ring attached thereto, to retrieve the larger or heavier load.

If one needs to use only the cord to retrieve a larger or heavier load it is important to be able to quickly detach the connector and the cord from the throwable rescue ring and then quickly reattach the connector and cord to the larger or heavier load that is to be retrieved using only the connector and the cord. Since the connector is located deep within an annular cord storage chamber in the throwable rescue ring it is difficult or sometimes impossible for a person while on-the-go to get his or her hand into the annular storage chamber to quickly detach the connector from the rescue ring so the connector can be attached to a different object. That is, the size and depth of the cord storage chamber within the rescue ring make it difficult for a person to use his or her hand to release the connector and the cord from within the throwable rescue ring so that the cord and the connector can be used to retrieve an object.

SUMMARY OF THE INVENTION

A rescue device or throwable rescue ring having a cord and a connector attached thereto with the cord and connector wound within the rescue device where the rescue device typically comprises an aerodynamic annular member having an upper outer peripheral surface having an airfoil shape and an inner upper peripheral surface also having an airfoil shape, with the upper outer peripheral surface forming a leading edge of the annular member and the inner peripheral surface forming a trailing edge of the annular member as the rescue ring is thrown to a person in distress. The rescue device includes an internal slip band with a loop pivotally attached to the slip band, which is rotationally positioned within the rescue device. A cord with a connector that one can attach to the loop, which is normally held within a cord storage compartment in the rescue device allows one to retrieve the rescue device. As the rescue device is thrown to a person in distress the cord unwinds from the rescue device.

Once the rescue device arrives at the destination the loop, which is located within the rescue device can be pivoted outward so that at least a portion of the loop and the connector extend out of the cord storage compartment. Pivoting the loop outward from the cord storage compartment brings an attachment or connection point of the loop outside the throwable rescue ring where a user can grasp the connector and quickly detach the connector from the loop. Once the connector is detached one can quickly attach the connector and cord to an item that can be retrieved using the cord and the connector without the throwable rescue ring attached thereto.

BRIEF DESCRIPTION OF THE DRAWINGS

FIG. 3 is an isolated view of a slip band with a cord and connector wound around the outer surface of the slip band;

FIG. 3A is a partial sectional side view showing the slip band of FIG. 3 located in an annular cord chamber in the rescue device with a portion of a connector hook end extending through the slip band into an annular guide channel in the rescue device;

FIG. 3*b* is an isolated view of a separable slip band for winding a cord and connector wound around the outer surface of the slip band;

DESCRIPTION OF THE PREFERRED EMBODIMENT

Figure 1:
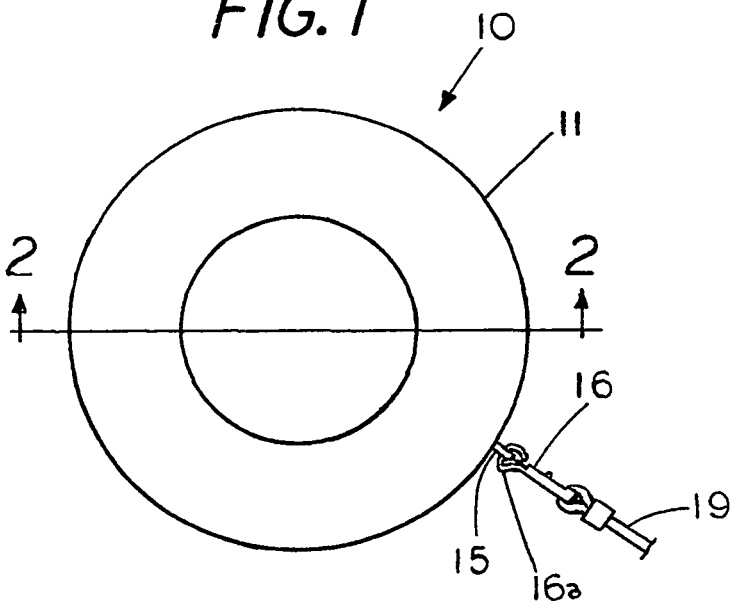
FIG. 1 is a top view of a throwable rescue device.
Figure 2:
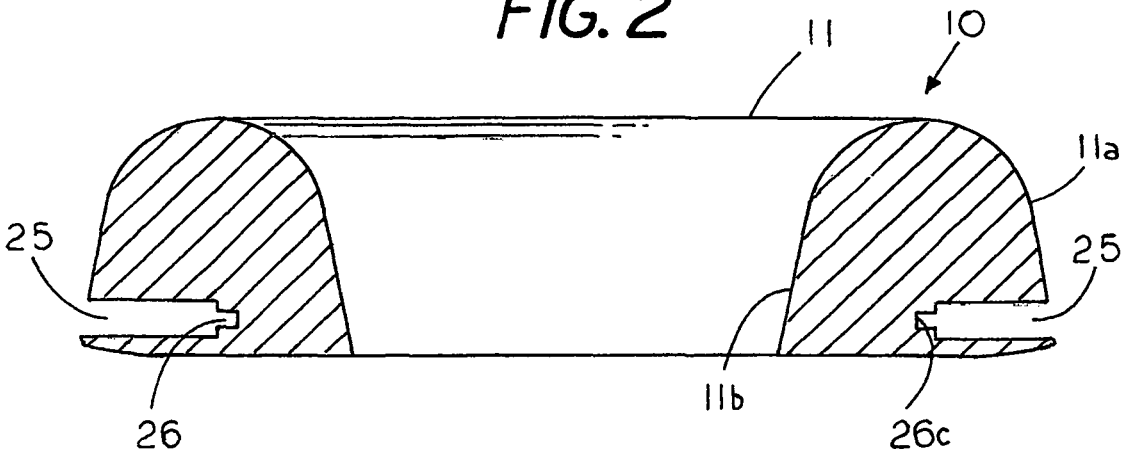
FIG. 2 is a sectional view the rescue device of FIG. 1 taken along lines 2-2 of FIG. 1 condition without a cord and slip band therein.

FIG. 1 is a top view of a rescue device 10 in a ready to throw condition and FIG. 2 is section view of a rescue device 10 of FIG. 1. Typically, rescue device 10 comprises a throwable rescue ring 11 made from a lightweight material that floats if the throwable rescue ring lands on water, however, the throwable rescue ring requires sufficient mass so that the momentum imparted to the throwable rescue ring through hand throwing is sufficient to deliver the throwable rescue ring to its destination. The throwable rescue ring 11 may be molded from a polymer plastic with the material having sufficient tensional strength so that one pulling on the cord 16*a*, which is attached to the throwable rescue ring, can bring a person grasping the throwable rescue ring to safety. Examples of throwable rescue rings can be found in my U.S. Pat. Nos. 5,562,512; 8,216,014; 8,708,762 and 9,656,732, which are hereby incorporated by reference.

FIG. 1 is a top view of a rescue device 10, which comprises an annular ring 11 having an elongated pivotable loop 15 extending radially outward from an annular peripheral cord chamber within annular ring 11. In the example shown in FIG. 1, FIG. 2 and FIG. 3 the rescue device 10 includes a slip band 17 with a pivotable loop 15 connected to a hand detachable connector 16 with the hand detachable connector having a cord 16*a* attached thereto for retrieving rescue device 10 after it has been thrown to a person in distress.

Figure 2A:
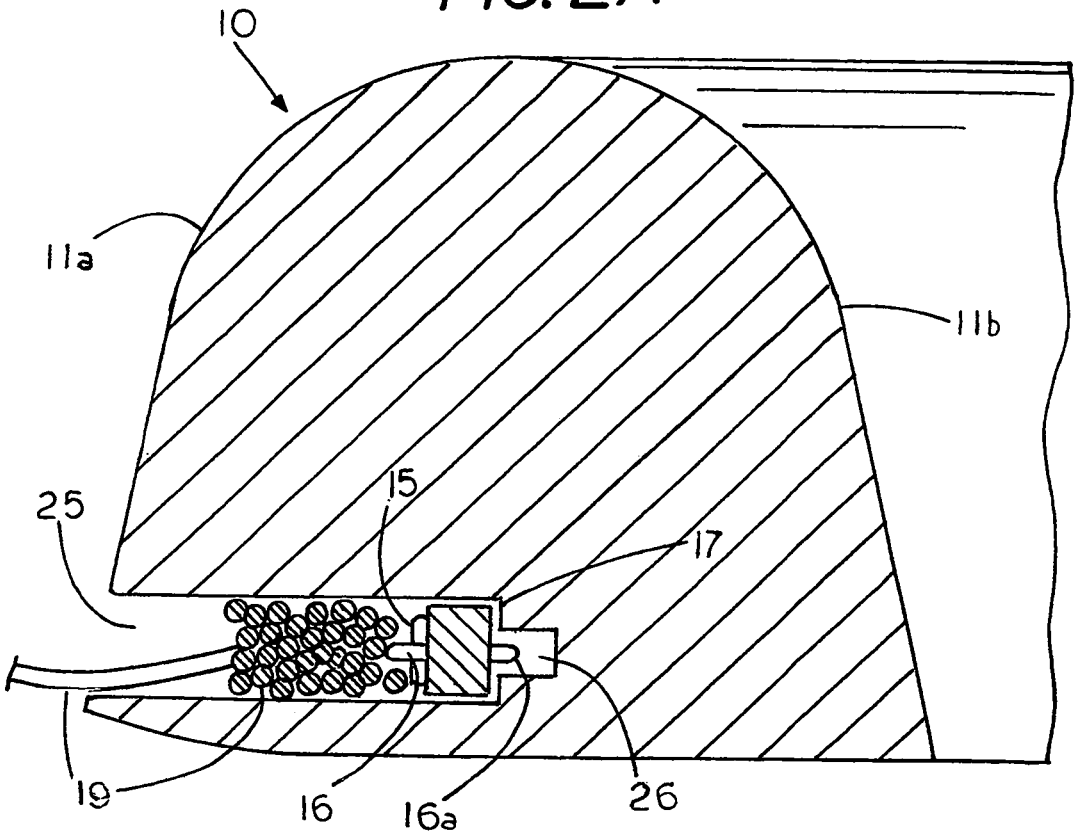
FIG. 2A is a sectional view of a portion of the rescue device of FIG. 1 with a cord and a slip band located in an outer annular peripheral cord chamber in the rescue ring.
Figure 2B:
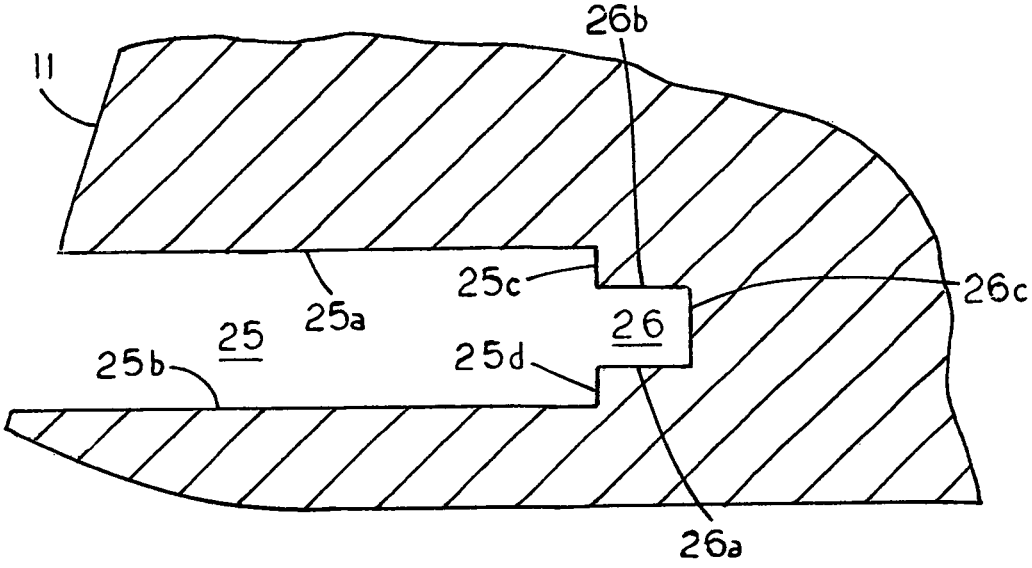
FIG. 2B is an isolated view of the outer annular peripheral cord chamber and an annular guide channel without a cord and slip band therein.

FIG. 2B is a sectional view showing an empty cord chamber 25 and FIG. 2A shows cord chamber 25 with cord 19 wound and stored within an annular peripheral cord chamber 25, which is located in the outer peripheral portion of rescue ring 11. FIG. 2A shows slip band 17 rotationally supported in a first annular peripheral chamber 25 with a triangular shaped loop 15 (i.e. a closed loop) such as an elongated chain link pivotally attached to slip band 17. Loop 15 having a width less than the width of peripheral chamber 25 to enable loop 15 to be pivoted so that at least a position of loop 15 is outside of rescue ring 11 (see FIG. 4A) for attachment or detachment of a connector 16 thereto. Loop 15 is also pivotable inward into chamber 25 to bring loop 15 proximate slip band 17 as shown in FIG. 3A. FIG. 2B shows that peripheral cord chamber 25 is formed within annular ring 11 by an annular top side 25*a*, an annular bottom side 25*b* and a first slip ring bearing surface 25*c* and a second slip ring bearing surface secured by a connector guide chamber 26, which is formed by an annular top surface 26*b* and a lower annular surface 26*a* and an annular end surface 26*c*.

Figure 4:
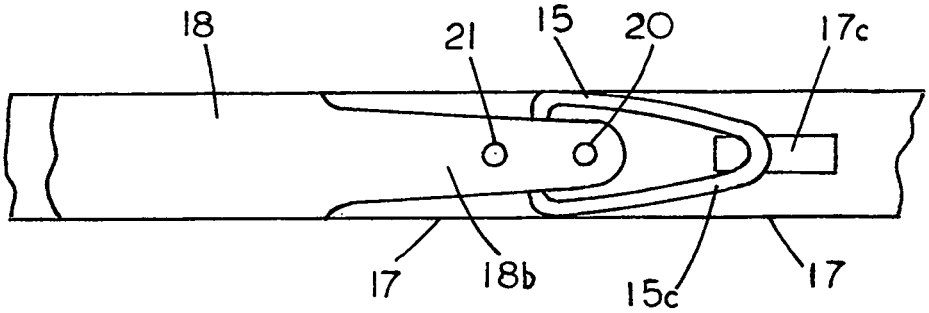
FIG. 4 is an isolated top view of a loop pivotally attached to the slip band of FIG. 3.
Figure 4A:
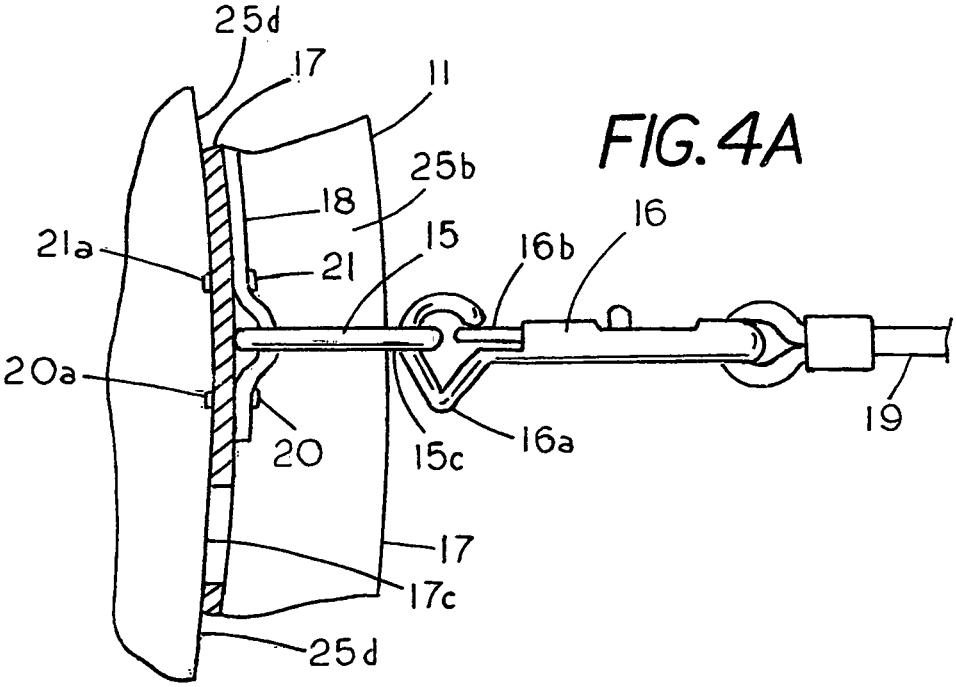
FIG. 4A is a side view of the end of the loop in engagement with a connector where the attachment position of the loop is outside the periphery of the rescue device.

FIG. 3 is an isolated view of slip band 17, which is a continuous band and FIG. 3A is a sectional view of a portion of annular ring 11 showing elongated loop 15 pivotally connected to hand detachable connector 16 through a tongue 18*b* on strap 18, which is secured to slip band 17. FIG. 4 is an isolated view that shows strap 18, which is fastened to loop 15*c* through a tongue 18*b* with a first fastener 20 attached to ring 17 on one side of loop 15 and a second fastener 21 attached to ring 17 on the opposite side of loop 15 to hold loop 15 in a pivotal condition. In this example tongue 18 is secured to band 17 through a fastener such as a pan head screw 21 with a pan shaped end 21*a* and fastener 20 such as a pan head screw 20 with a pan shaped head end 20*a*. Loop 15 is free to pivot from a stored condition within chamber 25 (see FIG. 2A) until loop 15 extends radially outward as shown in FIG. 4A. FIG. 3B shows an isolated side view of a one piece separable slip band 37 that has a first end 37*a* and a second end 37*b* that are secured to each other in a face to face condition by a first fastener such as a rivet or bolt 38 having a nut 38*a* and a second fastener 39 having a nut 39*a*. The fasteners 38 and 39, which extend through both end 37*a* and 37*b*, hold slip band end 37*a* and slip end band 37*b* proximate each other to form a circular slip band for use in the rescue ring. The advantage of a separable slip band 37 is that it allows one to spread the ends 37*a* and 38*a* to insert the slip band 37 around the periphery of a circular bearing surface within the rescue ring after the rescue ring has been formed.

In the example shown in FIG. 4A the a free end 15*c* of loop 15 is pivotable to a position where free end 15*c* is located outside of annular ring 11 for attachment or removal of a quick connector 16 thereto. While a triangular shaped loop 15 is shown other shaped attachments to slip band 17 may be used as long as a portion of the attachment can be extended outside of annular ring 11 to enable a user to quickly attach or detach a connector 16 to the portion of the attachment that is extended outside of the annular ring 11.

In the example shown loop 15, which is shown in a folded condition in FIG. 2A and FIG. 3A, is pivotable at least partially outward of the annular peripheral chamber 25 in annular ring 11 to facilitate engagement of loop 15 to a connector 16 (see FIG. 4A). To facilitate storing of loop 15 in a ready to throw condition in annular ring 11 one folds loop 15 into a position proximate slip band 17 (see FIG. 3A) and then winds connecter 16 and cord 19 around the slip band 17 (see FIG. 2A), which is located at the bottom of annular peripheral chamber 25 as illustrated in FIG. 2A.

FIG. 3A shows connector hook 16*a* on connector 16 extending partially through an opening 17*c* in slip band 17 and into an annular guide channel 26. During rotation of the slip band 17 the portion 16*a* of connector hook 16 that extends through the slip band 17 and into the annular guide chamber 26 is free to rotate within annular guide chamber 26 as slip band 17 rotates in chamber 25. Extending connector 16 partially through the slip band 17 allows one to minimize the profile of the connector 16 on slip band 17 thus allowing one to use connectors that are sufficiently large to be conveniently and quickly hand opened or hand closed by a person who receives a thrown rescue ring 11. A feature useful if a person needs to quickly attach connector 16 to an article that is to be retrieved using cord 19 and connector 16.

A further feature of the invention is the dual use of rescue device 10. That is, in one mode a person in distress can grasp rescue ring 11 allowing the thrower to pull the person in distress to safety. In another mode the rescue device 10 can be used for pulling an object to the thrower by disconnecting the connector 16 from the rescue device and attaching the connector to the object that is to be pulled to the thrower.

One of the difficulties in storing connector 16 within storage chamber 25 is that for connector 16 to be large enough to be useful for attachment to other objects the connector should have a sufficiently large hook end 16*a* (see FIG. 3A, FIG. 4A and FIG. 4B), which can interfere with storing or unwinding of cord 19 from within chamber 25. To prevent connector hook end 16*a* from interfering with unwinding of cord 19 one reduces the radial profile of connector 16 by allowing a portion of hook end 16*a* to extend through an opening 18*c* in slip band 17 as shown in FIG. 3A. Unfortunately, if the hook end 16*a* extends through the slip band 17 it can interfere with rotation of the slip band within annular ring 11. To prevent interference annular ring 11 includes an annular guide chamber 26 (see FIG. 2A and FIG. 2B) that is concentric with peripheral cord chamber 25 to allow a protruding hook end 16*a* or 27*a* to follow in guide chamber 26 as the slip band 17 and connector 16 rotate with respect to annular ring 11. That is, as shown in FIG. 2A laterally protruding hook end 16*a* extends radially into guide chamber 16 as the slip band 17 rotates within rescue device 10. Guide chamber 26 is sufficiently large so that a protruding portion of hook 16 does not engage the side wall of chamber 16 as the slip rotates, which may hinder unwinding of cord 19 as the rescue device 10 is thrown to a person in distress.

Figure 4B:
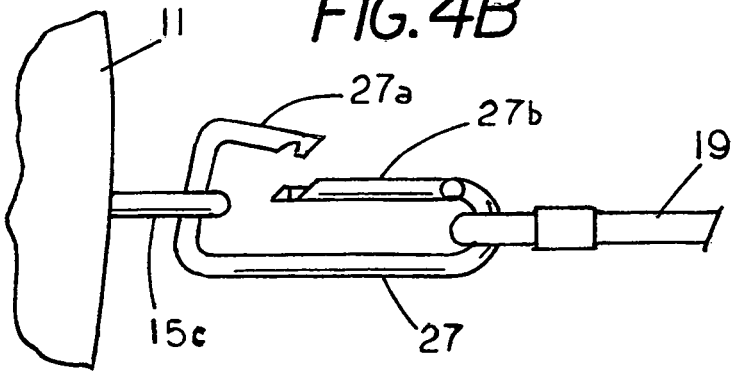
FIG. 4B shows a carabineer being attached to a loop as the end of the loop extends outward of the rescue device.

A feature of the invention is the ability to store cord 16*b* and connector 16 in a flat non hand accessible condition (see FIG. 2A and FIG. 3A) within a narrow annular peripheral chamber 25 while still allowing a person to easily detach connector 16 from slip band 17. That is, chamber 25, which holds the cord 19 and connector 16 in a flat or wound condition, is sufficiently narrow and located sufficiently deep in rescue ring 11 so that it is impractical for person to insert his or her hand into chamber 25 to disconnect connector 16 from slip band 17. In order to provide for both storage and quick release of connector 16 the slip band includes a strap 18 with a tongue 18 that supports loop 15 in a pivotal condition on slip band 17 to allow loop 15 to be pivoted radially outward so that at least a portion of loop 15 is located outside of the annular ring 11 to bring a connector detachment point to loop 15 outside of the annular ring 11 (see FIG. 4A), which in this example allows one to slide connector tongue 16*b* backward to open connector 16 and thus free connector 16 from link 15. Once connector 16 is released from loop 15 one can quickly attach the connector to an object that is to be retrieved. One can then use cord 19 to retrieve the object. One example of a connector with a connector that has a hook that can be quickly detached from the loop 15 is shown in FIG. 4A and another example, which is shown in FIG. 4B, is a carabineer 27 having a hook end 27*a* and a spring latch 27*b* that can be depressed to allow the carabineer to be quickly connected to or disconnected to link 15.

Figure 4C:
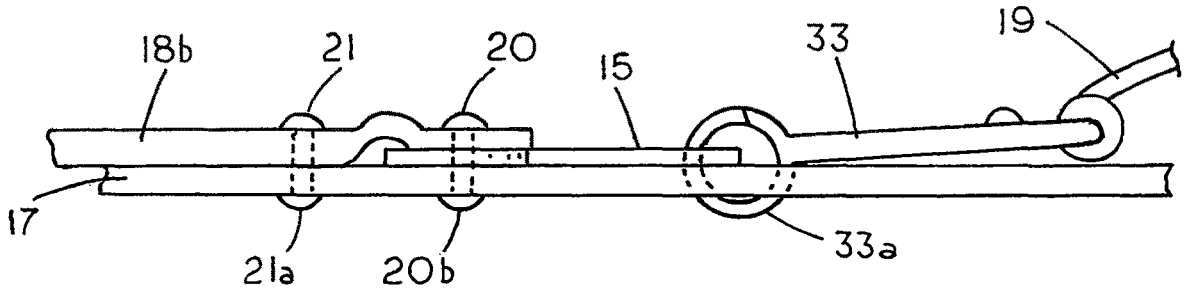
FIG. 4C is a side view of the slip band and a snap hook extending through an opening in the slip band.

FIG. 4C is a side view of the slip band 17 and a snap hook loop 33*a* extending through an opening in the slip band. Fastener 21, which has a low profile head, and fastener 20, which has a low profile head, extend through the slip band 17 and tongue 18*b* with fastener 21 having a low profile retainer end 21*a* and fastener 20 also having a low profile retainer end 20*b*. In this example snap hook loop 33*a* on snap connector 33 is shown extending through an elongated opening in slip ring 17.

When the rescue device 10 is in a stored or throwing condition connector 16 rests within chamber 25 on the outer peripheral portion of the rescue ring 11 as illustrated in FIG. 2A and FIG. 3A. As the rescue ring 11 is thrown slip band 17 rotates within the rescue ring 11 thereby releasing cord 19 from within the cord chamber 25. Since the slip band 17 is free to rotate within the rescue ring 11 the rotation of the slip band 17 within the chamber 25 becomes independent of the rotation of the rescue ring 11 thus allowing the cord 19 to spin freely out of the rescue ring as the rescue ring travels to a person in distress.

Figure 5:
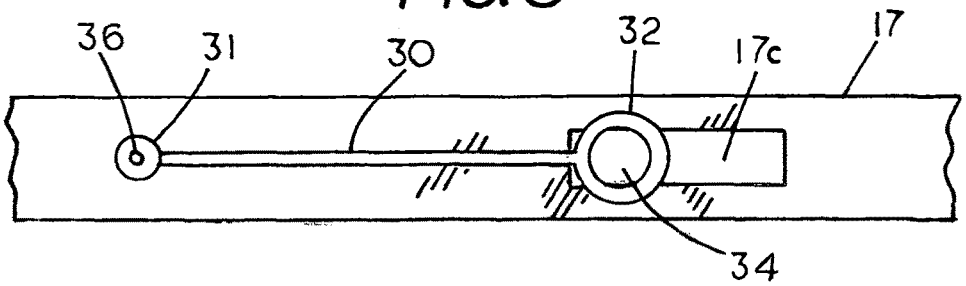
FIG. 5 is an isolated top view of a flexible cable connector with a loop for attachment to a connector attached to a retrieval cord.

FIG. 5 is an isolated top view of another type of connector that can be pivoted in our out of annular chamber 25. Connector 30 comprises a flexible cable connector 30 with a loop 32 having an opening 34 for attachment to a hand detachable connector connected to a retrieval cord. End 31 of flexible cable connector 30 is attached to slip band 17 with a fastener 36 such as a bolt or screw although other methods may be used to hold end 31 proximate slip band 17. The loop 32 on the opposite end of flexible cable connector 30 is positioned so that eye 34 of loop 32 is in alignment with opening 17*c* in slip band 17.

Figure 5A:
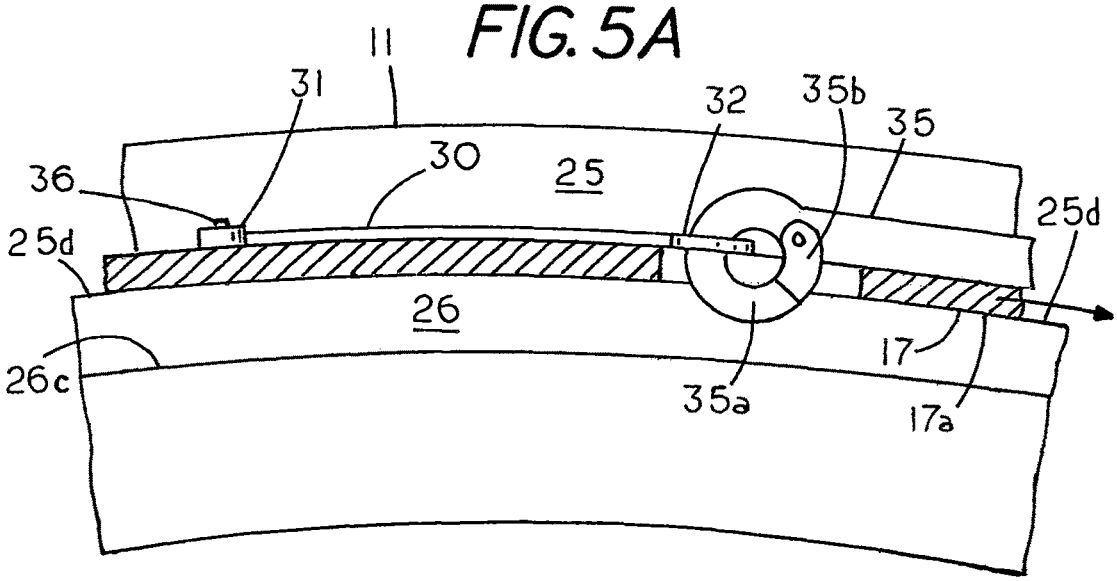
FIG. 5A is a partial side view of the end of flexible cable connector of FIG. 5 located in a rescue device with a cable connector loop in engagement with a hook connector where a portion of the hook connector extends through an opening in a slip band.
Figure 5B:
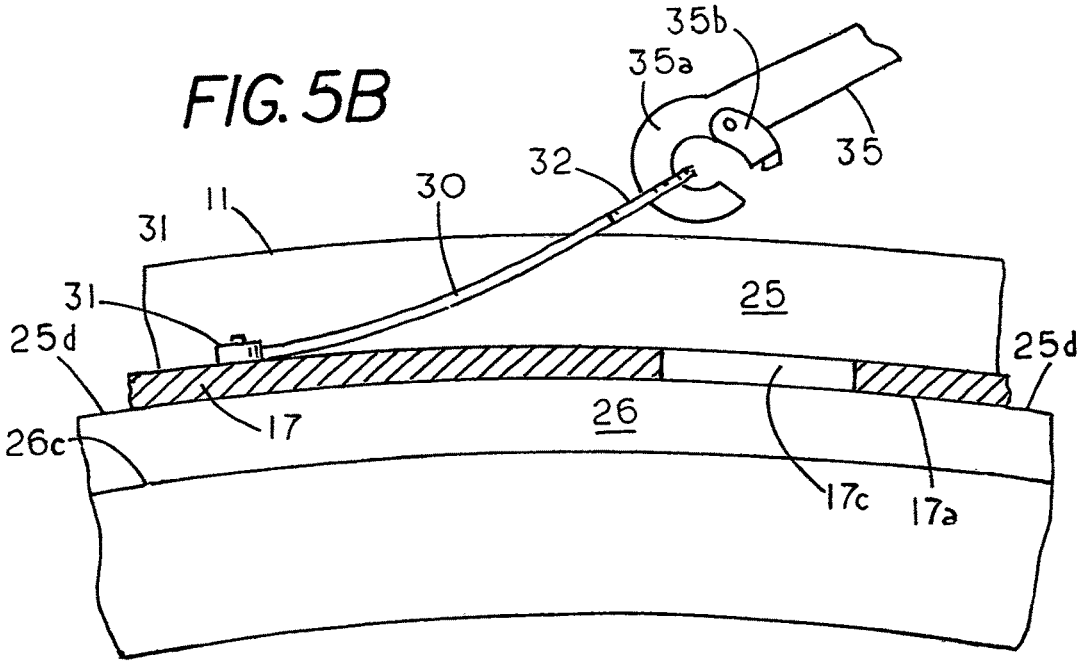
FIG. 5B is a partial side view of the cable connector of FIG. 5 with one end of the cable connector loop in engagement with a hook connector where the cable connector loop of the flexible cable connector has been flexed to a position outside the rescue device to facilitate attachment or detachment of a connector to the flexible cable connector.

FIG. 5A is a partial side view of the end of the flexible cable connector 30 of FIG. 5 located in a peripheral chamber 25 with the flexible cable connector in an abutting relationship with slip band 17 with a cable connector loop 32 in engagement with a hook end of a hand attachable or hand detachable connector 35. Note, Connector 35, which is sufficiently large to facilitate connection to another object, has a portion of a hook end 35*a* connector 35 extending through opening 17*c* in slip band 17 and into guide chamber 26 similar to the embodiment shown in FIG. 3A. FIG. 5A and FIG. 5*b* shows that During the throwing of annular ring 11 slip band 17 rotates within chamber 25 as annular surface 17*a* of slip band 17 slides on annular surface 25*d* of annular ring 11.

FIG. 5B is a partial side view of the flexible cable connector 39 with a cable connector loop 36 of flexible cable connector 30 in engagement with a hook end 35*a* of hand attachable or hand detachable connector 35. A pivotal link 35*b* on connector 39 can be opened or closed for attachment or detachment of connector 35 to cable connector 39. In the example shown in FIG. 5B the cable connector loop 32 of the flexible cable connector 30 has been flexed radially outward to bring loop 32 outside of chamber 25 to thereby facilitate attachment or detachment of connector 35 thereto.

Figure 6:
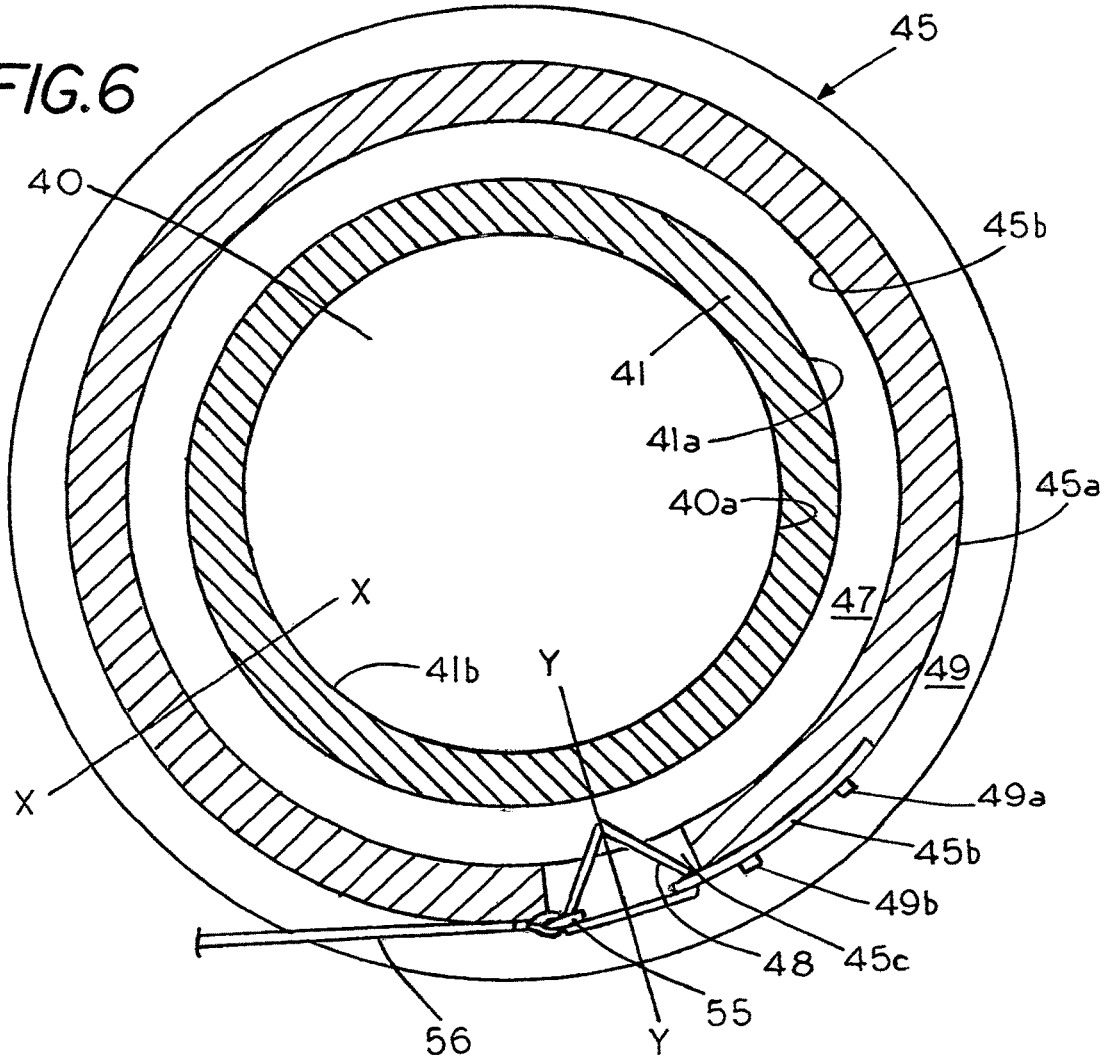
FIG. 6 is a sectional view of a reel rotationally mounting within a rescue ring.

FIG. 6 shows an example of a rotateable reel 45 for use in a rescue device. In this example a rotateable reel 45 is rotationally mounted on a circular central member 40, which is part of a rescue device. Central member 40 has an outer cylindrical bearing surface 40*a* for rotatably supporting reel 45 thereon. Reel 45 includes an annular guide chamber 47 for a portion of a pivotable link 48 to extend therein to reduce the profile of the hook 48 and an annular outer chamber 49 for winding cord 56 therein. In this example link 48 is supported by a strap 45*b* that is secured to rotateable reel 45 through screw fasteners 49*a* and 49*b*. Rotatable reel 45 has an opening 45*c* for a link 48 that is pivotally attached to reel 45 through strap 45*b* to allow link 48 to be pivot out of the chamber 49 to enable one to quickly release connector 55 and rope 56 from link 48.

Figure 6A:
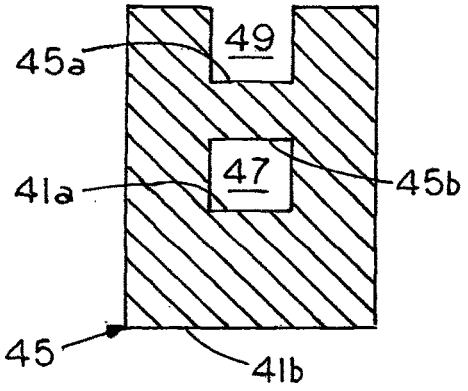
FIG. 6*a* is a sectional view taken along lines x-x of FIG. 6.
Figure 6B:
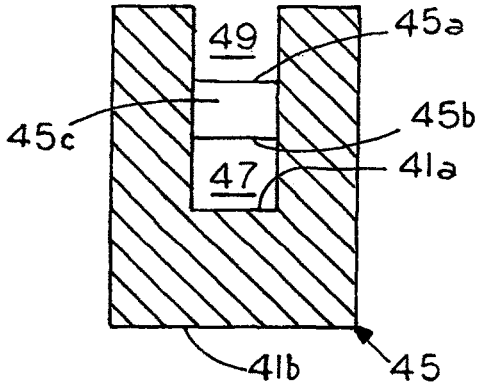
FIG. 6B is a sectional view taken along lines y-y of FIG. 6.
Figure 7:
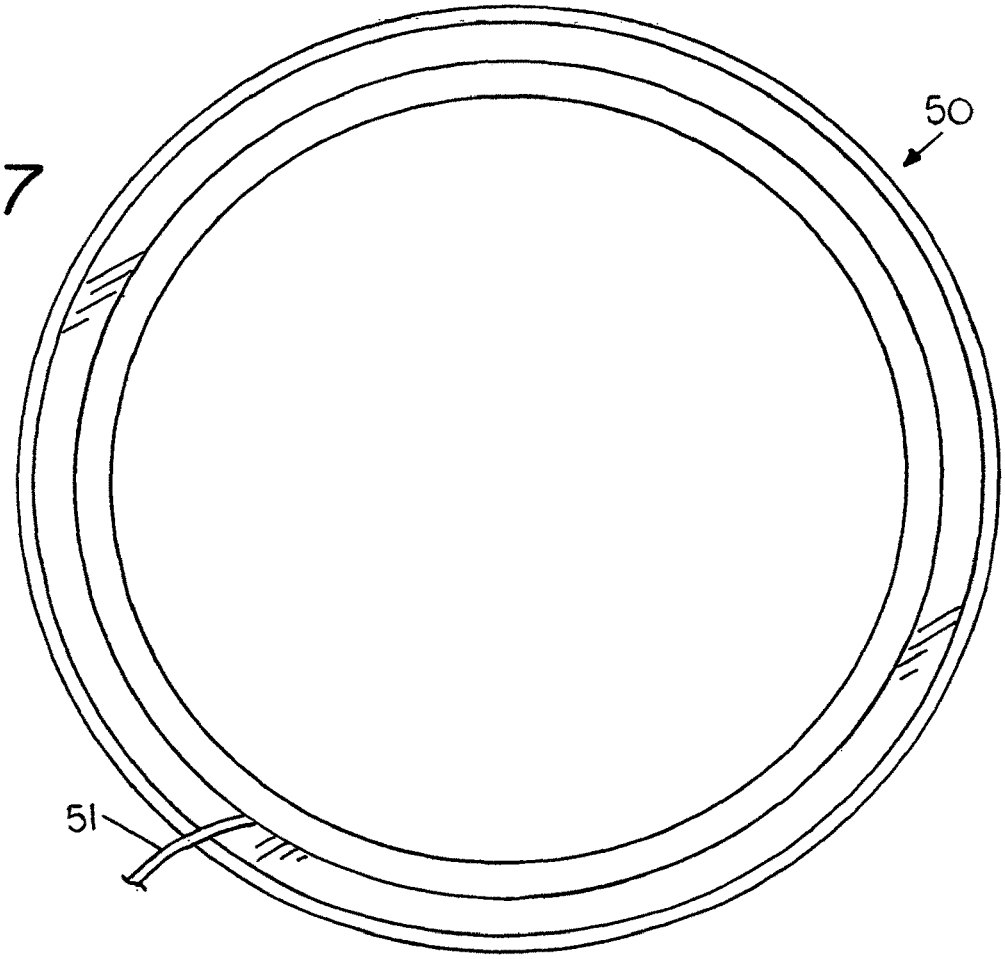
FIG. 7 is a top view of a frisbee shaped rescue device.
Figure 7A:
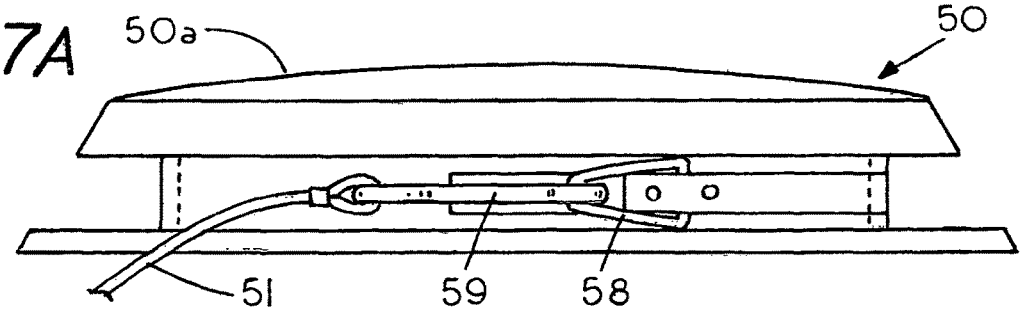
FIG. 7A is a side view of the frisbee shaped rescue device of FIG. 7.

FIG. 6A is a sectional view of a reel 45 taken along lines x-x of FIG. 6 showing the outer annular chamber 49 for winding a cord therein and guide chamber 47 rotationally mounting within a rescue ring;

FIG. 6B is a sectional view taken along lines y-y of FIG. 6 showing the outer annular chamber 49 and the opening 45*c* therein for extension of loop 48 therein:

FIG. 7 is a top view of a frisbee shaped rescue device 50 with a cord 51 attached thereto and FIG. 7A is a side view of the frisbee shaped rescue device of FIG. 7 showing a rotateable slip band 50*c* supporting a pivotal link 58. A snap connector 49 is shown attached to pivotal link 58 so that the snap connector 49 can be quickly released when the link 58 is pivoted to a condition to bring the attachment point of the link 58 outside of the rescue device 50 to allow for quick release of snap connector 59 from link 58.

While the invention is shown in relation to a slip band in a rescue device the use of a loop or flexible cable may be used with rescue devices without slip bands. In such a device an annular cord chamber, where it is difficult to retrieve the connector from may include a loop or cable to pivot out of the annular cord chamber for attachment or detachment of a connector thereto. In such cases one can lower the profile of the loop or flexible cable in the rescue device by forming a recess in the rescue ring where the connector can rest during the winding and unwinding of the cord attached thereto.

I claim:

1. A hand throwable rotateable rescue device comprising:

an annular member having an outer peripheral surface having an airfoil shape and an inner peripheral surface having an airfoil shape, with the outer peripheral surface forming a leading edge of the annular member, said annular member having a first annular peripheral chamber for storing and unwinding a cord therefrom as the rotateable rescue device is thrown and a second annular peripheral chamber comprising a connector guide with the second annular peripheral chamber radially spaced from the first annular peripheral chamber;

a slip band rotationally supported in said first annular peripheral chamber;

a loop having a first end pivotally secured to the slip band therein with a free end of said loop pivotable out of the first annular peripheral chamber for attachment or removal of a connector and pivotable into the first annular peripheral chamber for winding the connecter and the cord around the slip band while a portion of the connector extends through the slip band into the connector guide as the slip band rotates within the rotateable rescue device.

2. The throwable rotateable rescue device of claim 1 wherein the first annular peripheral chamber and the second annular peripheral chamber are concentrically spaced from each other.

3. The throwable rotateable rescue device of claim 1 wherein the loop comprises an elongated loop having a length greater than an axial depth of the first annular peripheral chamber and a width less than a width of the first annular peripheral chamber to permit the loop to freely extend outward of the first annular peripheral chamber.

4. The throwable rotateable rescue device of claim 1 wherein the connector comprises a carabineer.

5. The throwable rotateable rescue device of claim 1 wherein the connector comprises a hook having a latch thereon.

6. The throwable rotateable rescue device of claim 1 wherein the slip band comprises a rigid band with a further connector pivotally securing the loop to the slip band.

7. The throwable rotateable rescue device of claim 1 wherein a cord is secured to the slip band to allow rotation of the slip band with respect to the rotation of the rotateable rescue device as the rotateable rescue device is thrown to a person in distress.

8. The throwable rotateable rescue device of claim 1 wherein the first annular peripheral chamber and second annular peripheral chamber each extend 360 degrees around the rotateable rescue device.

9. A hand throwable rotateable rescue device comprising:

a first annular side wall and a second annular side wall extending around a periphery of the rotatable rescue device;

a first annular bearing surface adjoined to the first annular sidewall and a second annular bearing surface adjoined to the second annular sidewall with the first annular side wall and the second annular sidewall forming a portion of a storage compartment for a cord therein;

a third annular sidewall; and a fourth annular side wall with said third annular side wall and said fourth annular side wall forming an annular connector guide within the rotatable rescue device.

10. The hand throwable rotateable rescue device of claim 9 wherein the annular connector guide is concentrically positioned with respect to the storage compartment.

11. The hand throwable rotateable-rescue device of claim 9 wherein the annular connector guide is located radially inward of the first annular bearing surface and the second annular bearing surface.

12. The hand throwable rescue device of claim 9 including a slip band for insertion into the rotateable rescue device where the slip band includes a bearing surface for rotationally engaging the first annular bearing surface and the second annular bearing surface within the hand throwable rescue device; and a loop pivotally secured to the slip band with the loop attachable to a connector when the loop is in an extended condition outside of the rotateable rescue device.

13. The hand throwable rotateable rescue device of claim 9 wherein the slip band comprises a rigid annular slip band.

14. The slip band of claim 13 wherein the rigid annular slip band comprises aluminum.

15. The slip band of claim 12 wherein the loop is a chain link pivotally securable to the slip band through a tongue secured to the slip band through a set of fasteners located on opposite sides of the loop.

16. The slip band of claim 12 wherein the loop is a flexible cable having an end extendible outside of the rotateable rescue device for attachment of a connector thereto.

17. The slip band of claim 13 wherein an opening in the slip band is in alignment with a connector guide in the rescue device when the slip band is located in the rescue device and rotationally supported on the first annular bearing surface and the second annular bearing surface.

18. A hand throwable rotateable rescue device including:

an annular cord chamber in said rotateable rescue device for storing a connector and a cord in a wound condition therein;

a loop pivotally secured at a bottom of the annular cord chamber with the loop connectable to a connector when said loop is in an extended condition with at least a portion of the loop located outside the annular cord chamber to provide quick attachment or detachment of the connector thereto.

19. The hand throwable rotateable rescue device of claim 18 including a recess for a portion of the connector therein when the connector and the cord are located in a wound condition in the annular cord chamber.

20. The hand throwable rotateable rescue device of claim 18 wherein the loop is an elongated loop freely pivotable to a radial position where at least a portion of the loop is located outside a periphery of the rotateable rescue device.

* * * * *